United States Patent [19]

D'Elia

[11] Patent Number: 4,851,274

[45] Date of Patent: Jul. 25, 1989

[54] MOLDABLE FIBROUS COMPOSITE AND METHODS

[75] Inventor: Conrad D'Elia, Libertyville, Ill.

[73] Assignee: Ozite Corporation, Libertyville, Ill.

[21] Appl. No.: 69,826

[22] Filed: Jul. 6, 1987

Related U.S. Application Data

[63] Continuation-in-part of Ser. No. 939,052, Dec. 8, 1986, abandoned.

[51] Int. Cl.[4] ..... B32B 5/06; B32B 5/08; B32B 17/12; E04B 1/76

[52] U.S. Cl. ..... 428/113; 28/112; 156/148; 156/221; 181/290; 181/294; 264/126; 264/258; 264/320; 264/324; 428/34.5; 428/34.7; 428/36.2; 428/36.4; 428/174; 428/284; 428/285; 428/286; 428/287; 428/288; 428/290; 428/296; 428/300; 428/301; 428/920

[58] Field of Search ..... 28/112; 156/148; 181/290, 294; 428/113, 284, 285, 286, 287, 288, 290, 300, 920

[56] References Cited

U.S. PATENT DOCUMENTS

| | | | |
|---|---|---|---|
| 3,752,721 | 8/1973 | Clark et al. | 156/148 |
| 3,765,998 | 10/1973 | Oswald et al. . | |
| 3,778,334 | 12/1973 | Sturgeon . | |
| 3,850,723 | 11/1974 | Ackley . | |
| 3,975,565 | 8/1976 | Kendall | 428/284 |
| 4,237,180 | 12/1980 | Jaskowski | 428/280 |
| 4,263,364 | 4/1981 | Seymour et al. . | |
| 4,310,585 | 1/1982 | Shannon . | |
| 4,379,802 | 4/1983 | Weaver et al. . | |
| 4,469,543 | 9/1984 | Segal et al. . | |
| 4,522,673 | 6/1985 | Fell et al. . | |
| 4,522,876 | 6/1985 | Hiers | 428/285 |
| 4,568,581 | 2/1986 | Peoples, Jr. | 428/35 |

*Primary Examiner*—James C. Cannon

*Attorney, Agent, or Firm*—Wood, Dalton, Phillips, Mason & Rowe

[57] ABSTRACT

A moldable fibrous composite having thermal and acoustical insulating characteristics and methods of production thereof are provided. The composite structure comprises a substrate, a middle layer and a non-woven top layer. The substrate may be in the form of a fibrous web or, alternatively, a thermoplastic film. The middle layer comprises mineral fibers of a sufficiently short length to substantially preclude interlocking of any of the mineral fibers with other fibers of the structure and to provide the structure with desired flexibility. The mineral fibers are present in a quantity sufficient to impart desired heat and sound insulating properties to the structure. The top layer may be made of organic fibers or a substantially uniform mixture of organic and inorganic fibers. In making the invention composite structure, the middle layer and the top layer are introduced onto the substrate, respectively. The three layers are thereafter consolidated, such as through needle punching. In addition, binders may be added to the composite structures so as to impart desired properties such as improved moldability.

48 Claims, 1 Drawing Sheet

FIG. 1
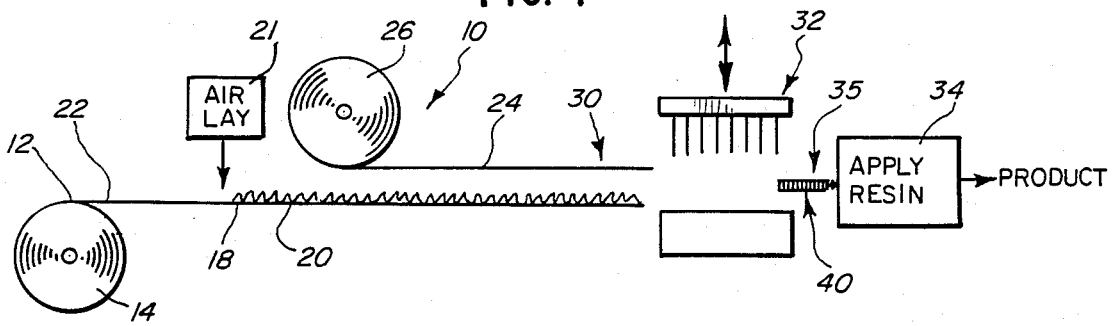
FIG. 2
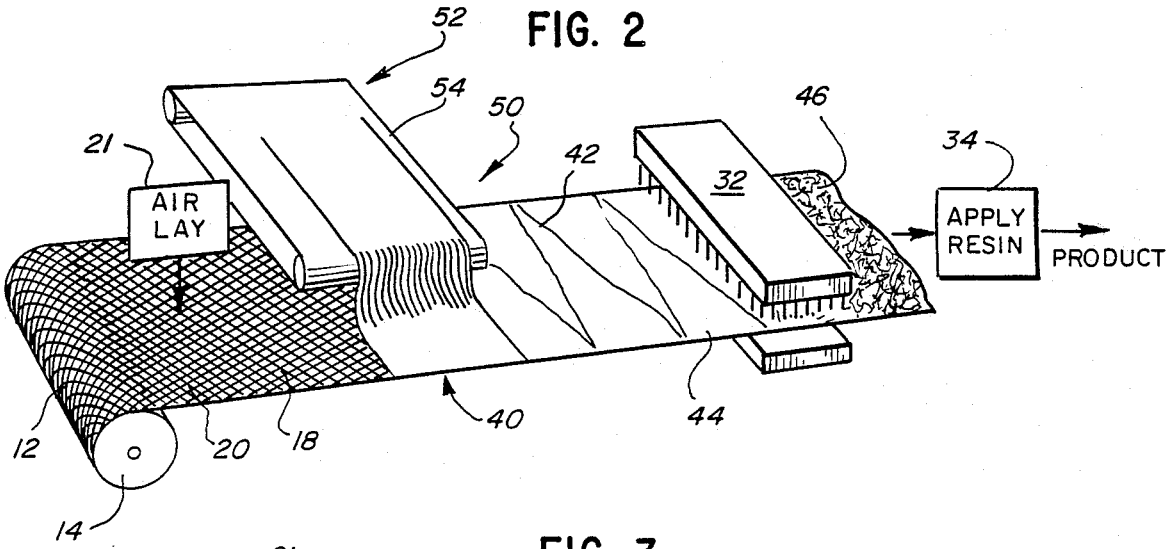
FIG. 3
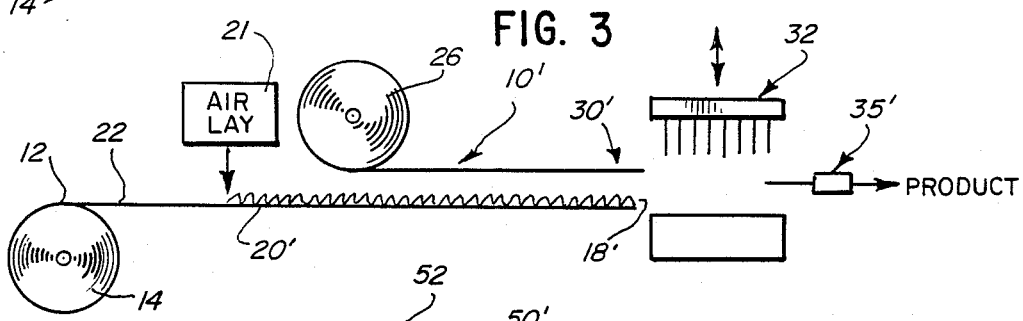
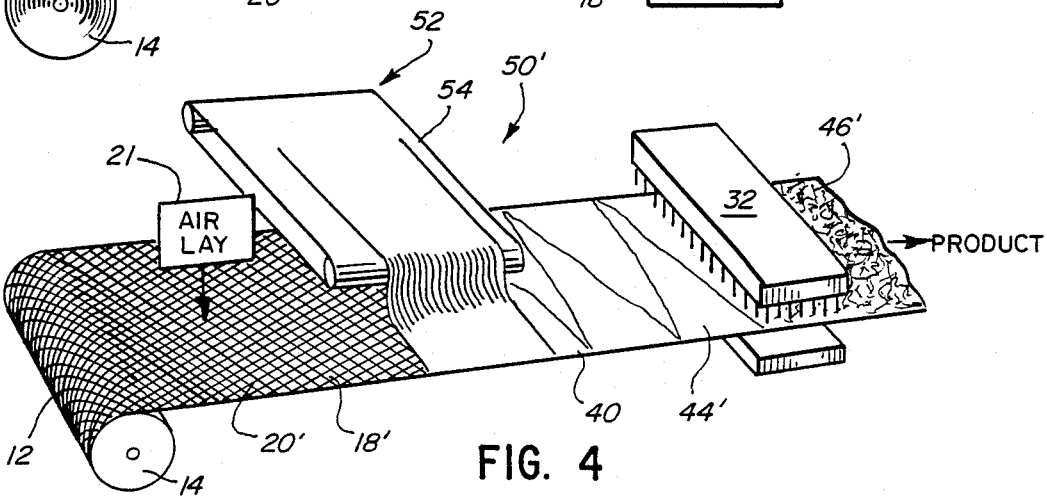
FIG. 4

MOLDABLE FIBROUS COMPOSITE AND METHODS

CROSS REFERENCE TO RELATED APPLICATION

This application is a continuation-in-part of application Ser. No. 939,052, filed Dec. 8, 1986, and now abandoned.

BACKGROUND OF THE INVENTION

1. Field of the Invention

This invention relates generally to fibrous structures and more particularly, this invention relates to moldable composites of inorganic fibers and organic fibers and methods of production thereof.

2. Description of the Related Art

There are many applications in industry where moldable thermal and acoustical insulating materials of relatively thin cross-section are sought and needed. For example, in the automobile industry, there is a demand for moldable non-woven trunk liners, truck bed liners, roof panels and the like having sound deadening properties as well as thermal insulating properties. In the building industry there is a demand for floor, wall and ceiling materials having these same and other properties.

In the past, it has been common to use a product formed by the combination of a needled product and shoddy, i.e., wool fibers obtained by shredding pieces of unfelted woolen or worsted waste fabric, so as to obtain thermal and acoustical insulating characteristics. In practice, it is common to glue shoddy having a mastic type material on its backside, to the needled material. The combination of the shoddy and the needled material can then be attached to a product by way of the mastic on the backside of the shoddy, the combination of the shoddy and the needled product serving to provide sound deadening and heat insulating properties to the material.

U.S. Pat. No. 4,522,876 issued June 11, 1985 to Hiers discloses a textile composite fabric of non-woven, needled textile fibers suitable for use as a filtration medium or as a heat insulator, such as on the floor board of an automobile. The composite fabric comprises at least one layer of laid and needled glass fibers and at least one layer of laid and needled textile organic fibers. Needling the layers of the composite by successive stages of more aggressive needling is disclosed. The aggressive needling results in a product that is relatively highly densified, i.e., the fibers are tightly interlocked. As a result of such a densified structure, the composite fabric cannot be easily molded. In fact, the patent does not even discuss moldability with respect to the composite fabric disclosed therein. In addition, aggressive needling of highly densified fibers results in a relatively greater proportion of the needled fibers breaking as opposed to comparatively less densified fiber needling.

U.S. Pat. No. 4,568,581 issued Feb. 4, 1986 to Peoples discloses a moldable material suitable for use as fiberous surfaced panels for automobile trunk compartments and the like. The material is produced by molding a heated non-woven web formed of a blend of relatively high melting fibers, such as polyester fibers, and relatively low melting thermoplastic fibers, such as polyethylene fibers. Such fibers are relatively long in length and result in drafting, i.e., thinning out, along curves or bends when being processed in conventional molding apparatus.

Also, thin, planar needle punched materials saturated with a thermoplastic latex have been used as vehicle interior trim materials. Such materials, because they are formed in very thin sheets, are comparatively lacking in insulating properties and moldability when compared to the above-described combination of shoddy and needled material. Thicker sheets of latex saturated punched materials while providing improved insulating characteristics, are generally cost prohibitive.

The conventional materials described above typically involve several steps in their preparation. For example, materials utilizing shoddy to provide insulating properties typically require, because of the non-uniform nature of the shoddy material, a preprocessing step such as carding. Further, such materials are not easily or economically incorporated into existing production techniques and systems, such as conventional molding processes.

SUMMARY OF THE INVENTION

It is an object of the invention to overcome one or more the problems described above.

According to the invention, an aesthetic trim material having thermal and acoustical insulating characteristics is provided. The composite structure includes a substrate, a middle or intermediate layer and a non-woven top layer. The needleable substrate defines a base side and a face side on opposite sides thereof. The middle or intermediate layer comprises mineral fibers of sufficiently short length to substantially preclude interlocking of any of the mineral fibers with other fibers of the structure and to provide the structure with desired flexibility. The mineral fibers are present in a quantity sufficient to impart desired heat and sound insulating properties to the structure. The top layer may comprise organic fibers or a substantially uniform mixture of organic and inorganic fibers. The fibers of the top layer are of a length whereby a sufficient portion of the fibers of the top layer interlock with the substrate upon needling to provide a substantially stable structure. Further, the fibers of the top layer are of sufficient strength and present in a sufficient quantity to provide the top layer with a uniform cross-sectional area upon subsequent needling, molding and combinations of needling and molding of the structure. The consolidated composition structure has a punch density of between about 400 to 3,000 penetrations per square inch.

In addition, the invention comprehends methods of making such composite structures.

Other objects and advantages of the invention will be apparent to those skilled in the art from the following detailed description taken in conjunction with the drawings and appended claims.

BRIEF DESCRIPTION OF THE DRAWINGS

FIG. 1 is a cross-sectional schematic view of a typical embodiment of an apparatus and a method for producing a composite structure according to the present invention.

FIGS. 2 and 4 are perspective schematic views of alternative embodiments of an apparatus and method for producing a composite structure according to the present invention.

FIG. 3 is a cross-sectional schematic view of an alternative embodiment of an apparatus and method for producing a composite structure according to the present invention.

DETAILED DESCRIPTION OF THE INVENTION

According to the invention, a moldable fibrous composite structure and method of producing the same are provided. The invention contemplates a composite structure having a substrate onto which is introduced a middle layer of mineral fibers of relatively short length and a non-woven top layer of organic fibers or a mixture of organic and inorganic fibers. Such composites are particularly useful as a precursor material for subsequent mold processing.

The substrate may be in the form of a thermoplastic film. Examples of typical thermoplastic materials useful as film substrates include polyethylene, polypropylene and polyester. Such thermoplastic film substrates can either be porous or made porous by subsequent processing, such as by needling, and can be used to improve the moldability of the composite structure by increasing the shape retention of the molded structure and also to reduce the need to add mold processing modifiers such as binders, the use of which will be described later herein, to the precursor material to facilitate the molding thereof.

Alternatively, the substrate may be in the form of a fibrous web. Such fibrous substrate webs may be woven or non-woven, made of organic fibers, inorganic fibers, or combinations thereof and may be formed by any suitable method such as by a spun bonded process or a melt blown process.

Examples of typical fibrous substrate web materials useful in the practice of the present invention include polyethylene, polypropylene, polyester, polystyrene, nylon, mylar and combinations thereof. The specific substrate web composition may be chosen on the basis of such factors as cost and specific end use. For example, if the composite structure of the invention is to be used in a application requiring molding thereof, a substrate of polyester fibers may preferably be used because such polyester fibers have comparatively better formability upon being molded.

Generally, the substrate, whether in the form of a thermoplastic film or a fibrous web, is of a sufficient mass to serve as a base upon which the relatively short mineral fibers can be further processed and to which a sufficient number of fibers of the top layer can interlock to provide a stable composite product, i.e., a product in which layers are substantially inseparable. The upper limit on the mass of the substrate is believed to be established only by the processing limitations of the subsequent processing equipment. For example, the substrate preferably should not be of such a great thickness that the specified degree of needle punching of the composite is precluded.

In the practice of the invention, substrates weighing 0.5 to 50 ounces per square yard are generally preferred. It being understood that thicker substrates are generally less flexible and, consequently, less moldable. When heavier materials are to be applied to the substrate, a heavier grade of substrate is generally used so as to provide additional strength. It being understood that relatively thick substrates are generally inappropriate for use in a composite structure which will subsequently be subjected to deep draw molding. Alternatively, when minimum weight, as opposed to high strength, is a desired characteristic, a substrate having a weight toward the lower end of the above-identified weight range will generally be used. Further, substrates weighing between about 0.5 to 15 ounces per square yard have been found to be useful in applications wherein the final composite structure will be subjected to extensive mold processing.

The middle or intermediate layer comprises mineral fibers such as rock wool fibers comprising a mixture of calcium, aluminum, magnesium and silicate. Such mineral fibers, though of a relatively low cost as compared to conventional insulating materials, impart substantial heat and sound insulating properties to the composite structure. The mineral fibers of the middle layer may be applied onto the substrate by any suitable process, such as an air blown or air lay process, whereby the mineral fibers are applied in a thickness effective in imparting substantial heat and sound insulating as well as molding characteristics to the material. As an example, the mineral fibers would comprise about 10 to 90 wt % of the fibrous components of the composite structure, with fiber reinforced products using the low end of the range and heat insulating materials using the high end of the range.

Generally, composites wherein the mineral fibers comprise less than 10 wt % of the composite structure do not provide a composite with sufficient insulating (acoustical and thermal) properties. Thus, for some applications requiring the composite to have additional insulating characteristics, composites wherein the mineral fibers comprise about 20 to 90 wt % of the composite structure have been found useful. Further, at a weight percent of less than 10, the mineral fibers are likely to be present in a proportion insufficient to contribute greatly to the moldability of the composite. Composites wherein the mineral fibers comprise more than 90 wt % of the composite structure are generally of insufficient stability as, relative to the mineral fibers, there is an insufficient amount of interlocking fibers, e.g., fibers of the top layer that, by needling, interlock with the substrate (later described herein).

The diameter of the mineral fibers does not appear to be critical and thus fine or coarse fibers may be used.

It has been found that mineral fibers of a relatively short length are generally preferred for those composites of the invention which subsequently undergo mold processing. In such composite structures, the short fibers provide the structure of the invention with improved flexibility, thus facilitating the bending of the structure around curves as is commonly required in mold processing. The degree of flexibility desired in the composite structure will be dependent on a number of factors including the particular application in which the composite will be applied and can be determined empirically by one skilled in the art guided by the teaching set forth herein. Also, the use of short fibers substantially precludes the interlocking of the mineral fibers of the middle layer with either other mineral fibers or with other fibers of the composite structure. For such applications, mineral fibers having an average length in a range of about $\frac{1}{8}$ to $\frac{1}{2}$ inch are generally preferred.

In addition, it is to be understood that the middle layer, in addition to the mineral fibers, may include various organic materials that act as binders. Typically, in such applications, a resin binder may be applied in a powdered form which is pre-mixed with the mineral fibers of the middle layer. The binder may be in the form of a dry resin fiber or particulate. These binders serve to bind the mineral fibers to themselves and to the substrate and may be chosen, for example, from PVC, phenolics, polystyrene, nylon, polyesters or ABS. The specific amount of binder used will of course vary depending upon the strength, rigidity and flow characteristics desired in the final structure. The amount of binder as a percent by weight of the mineral fiber may be as high as 50% or as low as 10% and in some applications for instance, when such composites are utilized in road repair and construction, the binder could be as high as 200% or more of the mineral fibers, for example.

A non-woven fibrous top layer is introduced onto the fibrous middle layer, which middle layer fibers had previously been laid onto the substrate, to form a precursor composite (i.e., a material that has not yet been needled). The fibrous top layer may comprise organic fibers or a substantially uniform mixture of organic and inorganic fibers, wherein a sufficient proportion of the top layer fibers are of organic fibers thereby providing the structure with sufficient processability for subsequent processing, e.g., molding. For example, a top layer comprising at least about 10% organic fibers is generally preferred. The fibers of the top layer may, for example, be polypropylene, polyester, nylon, acrylic or even glass, depending on the application in which the structure is to be utilized.

The fibers of the top layer are generally present in sufficient proportion relative to the mineral fibers of the middle layer to result, upon needling, in a stable product, i.e., a composite structure for which layers thereof are substantially inseparable. Thus, the fibers of the top layer generally comprise about 10 to 90 wt % of the total of the fibers of the top and middle layers or, for those composites comprising a minimum of 20 wt % mineral fibers, the fibers of the top layer comprise about 10 to 80 wt % of the total of the top and middle layers.

In addition, a sufficient proportion of the top layer fibers are of a length sufficient to interlock with the substrate upon needling. For example, top layer fibers having an average length of between about 1½ to 7 inches have been found useful in the practice of the invention. Top layer fibers having an average length of between about 1½ to 5 inches have found particular utility in the practice of the invention. It being understood that longer top layer fibers generally result in a stronger, more stable composite structure and that 7 inches is about the maximum length of fiber generally available.

The fibers of the top layer must be present in a sufficient mass to result in the formation of a stable product wherein a sufficient proportion of the top layer fibers, upon needling, interlock with the substrate and to provide an integral covering for the short mineral fibers of the middle layer. Also, the fibers of the top layer are generally present in sufficient quantity to provide a top layer having a substantially uniform cross-sectional area upon subsequent needling, molding, and combinations of needling and molding of the precursor composite. Thus, the top layer generally has a weight between about 3–20 ounces per square yard, with top layers weighing 5 to 20 ounces per square yard having been found to have particular utility.

The top layer may be introduced into the structure in any conventional manner such as by way of cross-lappers or, alternatively, in a pre-needled form such as in the form of needled batt, as will be described later herein.

The precursor composite is consolidated in any of a wide variety of ways. For example, a preferred method of consolidation is needle punching the material. Needle punching comprises the steps of passing a plurality of elongated needles into the material being processed and subsequently removing them therefrom. Needle punching consolidation is a common process in textile processing. In such needle punching consolidation of the material, the use of a 36 gauge needle with a plurality of small barbs in a densified arrangement has been found preferable. For example, Foster Needles 36 gauge HDB (high density barb) needle has been found to be useful in the practice of the invention. Such needles have barbs of a relatively short length as compared to conventional composite densifying needles. Further, the barbs of these needles are in a relatively highly densified arrangement as compared to the barb arrangement on conventional needles. Consequently, on the passage of a HDB needle through the top layer of the precursor composite, substantially all of the barbs of the needle attach top layer fibers. The barbs carry these attached top layer fibers through the mineral fibers of the middle layer without substantially damaging the mineral fibers and interlock the top layer fibers carried in the barbs with the substrate. Also, because the barbs are highly densified, these needles are generally operated with a comparatively short stroke. Further, such needles substantially reduce or eliminate the likelihood of mineral fibers of the middle layer attaching thereto and subsequently being passed to the substrate.

In effecting consolidation, a punch density of between about 400 to 3,000 penetrations per square inch has been found to be preferred and provides a high strength material that will not easily separate.

It is to be understood that highly densified composites, e.g., composites having a high punch density, are generally inappropriate for applications wherein the composite will be subjected to deep draw molding. Composites having a punch density toward the higher end of the above-identified punch density range are generally suited for applications requiring high strength and relatively less moldability, e.g., a packing shelf. Alternatively, composites having a punch density toward the lower end of the above-identified punch density range are generally preferred for applications wherein the composite will be subjected to relatively deep draw molding (e.g. up to about 18 inches), such as is commonly required for automobile trunk liner applications.

For example, composites having a punch density of about 400 to 600 penetrations per square inch are particularly suited for applications wherein the composite is subjected to extensive drafting, elongation and/or stretching. Composites having a punch density of between about 1200 to 1800 penetrations per square inch are useful in providing a relatively more rigid surface, such as a packing shelf, and which is subjected to relatively less mold drafting. Composites having a punch density of between 2000 to 3000 penetrations per square inch are particularly useful for construction applications requiring thick, heavy insulating composites.

It is also to be understood that various materials can be added to the composite structure to substantially increase the strength thereof without detrimentally effecting the moldability of the structure. For example, a layer of knitted or woven glass may be laid onto the substrate prior to the addition of the fibrous middle layer and top layer thereto or, alternatively, a layer of knitted or woven glass may be laid onto the fibrous middle layer, which middle layer fibers have previously been laid onto a substrate. Glass is a preferred material for such applications because it possesses high strength and is economically attractive as compared to other materials.

Although the needle punching is shown as being into the top side of the composite the needling could be from both sides for certain applications.

Referring to FIG. 1, a system for the preparation of the above-described structure and generally designated by the numeral 10 is shown. Initially, a fibrous substrate 12 of an appropriate material, as described above, is stored on a roll 14 and is fed through the system 10. A middle layer 18 comprising mineral fibers 20 from air layering apparatus 21 is laid onto the face side 22 of the substrate 12. Other means for applying mineral fibers onto the substrate of the composite will be obvious to those skilled in the art, guided by the teachings herein.

In the system 10, a non-woven fibrous top layer 24, as described above, of pre-needled fabric is stored on a roll 26 and is introduced onto the middle layer 18, whereby the mineral fibers 20 of the middle layer 18 are disposed between the substrate 12 and the top layer 24 to form a three layer composite 30. The three layer precursor composite 30 is then passed to a consolidation device, for example, represented by the needle punch 32. The needle punch 32 effects a consolidation and further strengthening of the structure, resulting in a needled composite 35.

At this point in the system 10, a resin binder such as those identified above may, if desired, be added. This addition of a resin binder is represented by the box 34. The addition of a resin binder by a process such as that represented by the box 34 may be in addition to or in the alternative to the use of a middle layer having the resin binder pre-mixed with the mineral fibers 20 of middle layer 18. The resin may be applied through any of a number of techniques, including, for example, spraying a liquefied binder solution onto the base side 40 of the substrate 12 of the needled composite 35 or, alternatively, using conventional roller coating or saturation techniques.

In those applications utilizing thermal setting resins which cure at a high temperature, the composite structure is subjected to forces as a result of the curing of the resin. Thus, it is to be understood that for these applications, it is generally preferable that the precursor composite comprise a generally symmetrical structure, e.g., a structure having a correspondence in terms of number, material of construction, and weights of the layers thereof. Generally, with such symmetrical precursor composite structures, the forces resulting from the curing of the resin will substantially equally effect the entire structure and thus minimize the likelihood that the structure will buckle as a result of uneven curing thereof.

The use of thermal setting resins which require high temperatures has found particular applicability in the preparation of building core materials and other forms of reinforcing structures. Consequently, inventive composite structures used for these applications and which include thermal setting resins which cure at high temperatures are preferably prepared in symmetrical forms.

Referring now to FIG. 2, an alternative system for the production of the above-described composite structure is illustrated and is generally designated by the numeral 50. The system 50 includes a fibrous substrate 12, roll 14, middle layer 18 of mineral fibers 20, air lay apparatus 21, etc., as in process 10 in FIG. 1. In process 50, however, the top layer 42 is shown as being applied by a technique known as cross-lapping wherein cross-lappers, generally designated by the numeral 52 and comprising lapper aprons 54 which traverse the substrate 12 and the middle layer 18 applied thereon in a reciprocating motion, are used to apply the top layer 42 on to the middle layer 18.

In all other aspects the system 50 is generally the same as that of system 10 of FIG. 1, e.g., in FIG. 2 the three layer precursor composite 44 and having the cross-lapped top layer 42 is passed to a needle punch 32 so as to effect consolidation thereof resulting in a needled composite 46. Optionally, if desired, a resin binder can be applied thereto as described with reference to FIG. 1.

FIGS. 3 and 4 show systems 10' and 50' which are similar to systems 10 and 50 of FIGS. 1 and 2, respectively, except in that they utilize a middle layer 18' of mineral fibers 20' pre-mixed with a resin binder and layered onto the bottom layer from apparatus 21 to thereby impart properties sought in the composite structure through the addition of binders thereto. The three layer precursor composites 30' and 44' of FIGS. 3 and 4, respectively, are passed to a needle punch 32 to effect consolidation thereof, resulting in the needled composites 35' and 46', respectively.

It is also to be understood, that if desired, one or more additional substrates may be interposed between the middle layer and the top layer of the above-described precursor composite so as to sandwich the middle layer between substrate materials. Such additional substrates are similar to the substrate described above and for a particular application, the additional substrates may have the same or different manufacturing parameters, such as material of construction, weight, etc., as the first substrate of the composite. The use of such additional substrates in the precursor composite results, upon needling, in a composite that has increased strength and for which the moldability thereof has not been substantially effected.

The determination as to whether to include additional substrates and, if so, of what material and weight will be dependent upon a number of factors such as desired properties and end application, for example, and can be determined empirically by one skilled in the art in view of the teaching set forth above.

The following examples of material made according to the invention set out specific ingredients and steps and relate the uses for the products made from the example. It is to be understood that all changes and modifications that come within the spirit of the invention are desired to be protected and thus the invention is not to be construed as limited by these examples.

EXAMPLE 1

A flat needle punched composite for trunk floors requiring no molding.

Rock wool mineral fibers in a weight of 20 ounces per square yard was processed through an air-lay system onto a polyester substrate weighing 0.5 ounces per square yard. A top layer of polyester fiber was then cross-laid from a garnet on top of the rock wool batting, the polyester top layer weighing about 8 ounces per square yard. The material was then densified by going through a needle punch resulting in about 600 penetrations per square inch. Upon densification, the product was back coated with an acrylic latex, thereby resulting in the application of the latex in a weight of 4 ounces per square yard.

EXAMPLE 2

A flat needle punched composite that is molded into trunk parts and packing shelves.

The process of Example 1 was followed except that the material was needle punched to result in 400 penetrations per square inch and rather than back coating with acrylic latex, the composite was saturated with about 8 ounces per square yard of PVC thermoplastic latex.

The composite so formed is then molded, using conventional compression molding techniques wherein the application of greater compressive forces results in a product having greater rigidity. Generally, for such compression molding, a pressure of at least 5 lbs/in$^2$ is applied to the composite.

EXAMPLE 3

Same procedure as Example 2 was followed but in place of saturation with PVC latex, the composite was coated with a polyethylene film of 10 ounces per square yard. The film was applied by extrusion with the film forming a non-permeable membrane that better enables the composite to retain its shape upon subsequent molding such as by compression or vacuum molding.

EXAMPLE 4

Same procedure as Example 2 was used but rather than saturating with pure PVC latex resin, the composite was saturated with a blend of multiple PVC latex and polyethylene powder. The blend was comprised of 40 wt. % PVC latex and 60 wt. % polyethylene powder. When the composite is back coated with such a blend, the multiple latex impregnates the composite leaving the polyethylene on the bottom surface of the substrate. When heated, the polyethylene flows to better approximate a film and enables the prduct to be better suited for subsequent vacuum molding. Thereafter, the composite is vacuum molded.

EXAMPLE 5

A flat needled interior trim and insulating composite.

6 ounces per square yard of rock wool inorganic fiber was processed through an air lay system onto a carded polyethylene fiber substrate weighing 5 ounces per square yard. A top layer of polypropylene organic fibers weighing about 9 ounces per square yard and measuring about 4 inches long was then densified by needle punching wherein the material was subjected to about 400 penetrations per square inch using fine gauge needles to achieve a composite thickness of about 1 inch.

EXAMPLE 6

PVC latex was frothed to form a foam. The composite of Example 5 was then saturated with the PVC latex foam in the amount of 15 ounces per square yard. Such a latex saturated composite, once subjected to heat, can be formed into shapes by using conventional low pressure molding wherein the composite is subjected to a molding pressure of no more than about 3 lbs/in$^2$.

EXAMPLE 7

A moldable structural composite structure useful in boat and automobile exteriors.

4 ounces per square yard of 6 denier polyester fiber was cross-laid to form a substrate. A layer of knitted glass was unrolled onto the substrate. A rock wool mineral fiber batting weighing 20 ounces per square yard was then processed through an air-lay system onto the knitted glass web. A top layer of 6 denier polyester fiber was then cross-laid from a garnet on top of the mineral fiber batting, the top layer weighing about 4 ounces per square yard. The precursor structure was impregnated with a polyester resin and then compressed via compression rolls to prevent any drafting or stretching of the material before needling. The material was then densified by being processed through a needle punch resulting in about 1,400 penetrations per square inch on each surface, so as to achieve a total needle punch density of about 2,800 penetrations per square inch.

The final needle composite material had an extremely uniform thickness of about 3 millimeters. The high number of penetrations resulted in the polyester fibers of the substrate and top layer being, to a great extent, buried within the composite. The high number of penetrations did not, however, harmfully increase the rigidity of the material as the mineral fibers were of a sufficiently short length that they did not get entangled with each other or with the polyester fibers.

The foregoing detailed description is given for clearness of understanding only, and no unnecessary limitations are to be understood therefrom, as modifications within the scope of the invention will be obvious to those skilled in the art.

I claim:

1. A stable moldable needled fibrous composite structure, comprising:

a first substrate defining a base side and a face side on opposite sides thereof, a middle layer adjacent to said face side of said first substrate, said middle layer comprising mineral fibers of sufficiently short length to substantially preclude interlocking of said mineral fibers with other fibers of said needled structure and to provide said structure with a desired degree of flexibility, said middle layer of mineral fibers initially having lacked structural integrity before being made an integral part of said composite structure, said mineral fibers being present in a quantity sufficient to impart desired heat and sound insulating properties to said structure, a non-woven top layer adjacent to said middle layer and opposite said substrate relative to said middle layer, said top layer comprising organic fibers or a substantially uniform mixture of organic and inorganic fibers with the organic fibers comprising more than 10 percent of said uniform mixture, said fibers of said top layer being of sufficient average length whereby a sufficient portion of said fibers of said top layer interlock with said first substrate as a result of needling said fibers through the top layer, middle layer and first substrate to provide a substantially stable structure, said fibers of said top layer being of sufficient strength and present in sufficient quantity to provide said top layer with a substantially uniform cross-sectional area, said needled structure having a punch density of between about 400 to 3,000 penetrations per square inch.

2. The composition structure of claim 1 wherein said substrate comprises a fibrous web formed by a melt blown process.

3. The composite structure of claim 1 wherein said substrate comprises a fibrous web formed by a spun bonded process.

4. The composite structure of claim 1 wherein said substrate comprises a thermoplastic film.

5. The composite structure of claim 4 wherein said thermoplastic film is porous and is selected from the group consisting of polyethylene, polypropylene, and polyester.

6. The composite structure of claim 3 wherein said fibrous substrate comprises a material selected from the group consisting of polyethylene, polypropylene, polyester, polystyrene, nylon, mylar and combinations thereof.

7. The composite structure of claim 1 wherein said mineral fibers comprise rock wool.

8. The composite structure of claim 1 wherein said mineral fibers comprise calcium, aluminum, magnesium and silicate.

9. The composite structure of claim 1 wherein said mineral fibers are air blown onto said face side of said substrate.

10. The composite structure of claim 1 wherein said top layer fibers are cross-lapped onto said mineral fibers of said adjacent middle layer.

11. The composite structure of claim 1 wherein said fibers of said top layer comprise a needled batt.

12. The composite structure of claim 1 additionally having an effective amount of a binder applied thereto.

13. The composite structure of claim 12 wherein said binder is selected from the group consisting of PVC, phenolic, polystyrene, nylon, polyester and ABS.

14. The composite structure of claim 12 wherein said binder is sprayed on said base side of said substrate.

15. The composite structure of claim 12 wherein said binder is roller coated to said composite.

16. The composite structure of claim 12 wherein said binder is applied by saturating said composite with said binder.

17. The composite structure of claim 12 wherein said binder comprises a resin which requires a relatively high temperature to cure, wherein said composite structure comprises a generally symmetrical structure.

18. The composite structure of claim 12 wherein said middle layer additionally comprises said binder.

19. The composite structure of claim 18 wherein said binder is pre-mixed with said mineral fibers of said middle layer.

20. The composite structure of claim 1 additionally comprising at least one additional needleable substrate interposed between said middle layer and said top layer.

21. The composite structure of claim 1 additionally comprising a layer of glass fibers interposed between said middle layer and said top layer.

22. The composite structure of claim 1 additionally comprising a layer of glass fibers interposed between said middle layer and said substrate.

23. A method for the production of a moldable fibrous composite structure, said method comprising the steps of:

introducing a first needleable substrate, said substrate defining a base side opposite a face side, introducing a middle layer comprising mineral fibers of sufficiently short length to substantially preclude interlocking of any of said mineral fibers with other fibers of said structure and to provide said structure with a desired degree of flexibility onto the face side of said first needleable substrate, said middle layer of mineral fibers initially lacking structural integrity, said mineral fibers being present in a quantity sufficient to impart desired heat and sound insulating properties to said structure, introducing a non-woven top layer comprising organic fibers or a substantially uniform mixture of more than ten percent organic fibers with inorganic fibers onto said middle layer whereby said middle layer is disposed between said first substrate and said top layer to form a precursor composite, said fibers of said top layer being of a sufficient average length whereby a sufficient portion of said top layer fibers interlock with said first substrate upon needling said fibers completely through the top layer, middle layer and first substrate to provide a substantially stable structure, said fibers of said top layer being of sufficient strength and present in sufficient quantity to provide said top layer with a substantially uniform cross-sectional area upon subsequent needling of said precursor composite, and thereafter needling said precursor composite by driving the needles completely through the top layer and middle layer and into the first substrate whereby said structure having a punch density of between about 400 to 3,000 penetrations per square inch is attained and said structure being producible on a continuous basis.

24. The method of claim 23 wherein said substrate comprises a fibrous web.

25. The method of claim 23 additionally comprising the step of forming said substrate.

26. The method of claim 25 wherein said substrate comprises a fibrous web and said step of forming said substrate comprises a melt blown process.

27. The method of claim 25 wherein said substrate comprises a fibrous web and said step of forming said substrate comprises a spun bonded process.

28. The method of claim 23 wherein said substrate comprises a thermoplastic film.

29. The method of claim 28 wherein said porous thermoplastic is selected from the group consisting of polyethylene, polypropylene, and polyester.

30. The method of claim 23 wherein said substrate comprises a material selected from the group consisting of polyethylene, polypropylene, polyester, polystyrene, nylon, mylar and combinations thereof.

31. The method of claim 23 wherein said mineral fibers comprise rock wool.

32. The method of claim 23 wherein said mineral fibers comprise calcium, aluminum, magnesium and silicate.

33. The method of claim 23 wherein said step of introducing said middle layer comprises air blowing said mineral fibers onto said face side of said substrate.

34. The method of claim 23 wherein said step of introducing said top layer comprises cross-lapping said top layer to said adjacent middle layer.

35. The method of claim 23 additionally comprising the step of pre-needling said fibers of said top layer.

36. The method of claim 23 additionally comprising the step of applying an effective amount of binder to said structure.

37. The method of claim 36 wherein said binder is selected from the group consisting of PVC, phenolic, polystyrene, nylon, polyester and ABS.

38. The method of claim 34 wherein said step of applying said binder comprises spraying said binder onto said base side of said substrate web.

39. The method of claim 36 wherein said step of applying said binder comprises roller coating said composite with said binder.

40. The method of claim 36 wherein said step of applying said binder comprises saturating said composite with said binder.

41. The method of claim 36 wherein said binder comprises a resin requiring a high temperature to cure, wherein said composite structure comprises a generally symmetrical structure.

42. The method of claim 36 wherein said step of applying said binder comprises the step of pre-mixing said binder with said mineral fibers of said middle layer.

43. The method of claim 23 wherein said step of needling said three layer composite comprises punching said three layer composite with a plurality of needles each having a plurality of small barbs in a densified arrangement.

44. The method of claim 23 additionally comprising the step of introducing at least one additional needleable substrate onto said middle layer prior to said introduction of said top layer to form said precursor composite.

45. The method of claim 23 additionally comprising the step of introducing a layer of glass fibers onto said middle layer prior to said introduction of said top layer to form said precursor composite.

46. The method of claim 23 additionally comprising the step of introducing a layer of glass fibers onto said substrate prior to said introduction of said middle layer thereto.

47. The method of claim 43 wherein the depth and spacing of the barbs on the needles are such that the barbs will pick up one or more fibers which will fill the barb, said needles penetrating said top layer, middle layer and substrate for locking the fibers of the top layer with the substrate.

48. The composite structure of claim 1 wherein said top layer of substantially uniform mixture of organic and inorganic fibers is comprised of at least 90 percent organic fibers.

* * * * *